United States Patent [19]

Strandli

[11] 4,436,035

[45] Mar. 13, 1984

[54] TUBULAR PROJECTILE

[75] Inventor: Kåre R. Strandli, Raufoss, Norway

[73] Assignee: A/S Raufoss Ammunisjonsfabrikker, Raufoss, Norway

[21] Appl. No.: 384,638

[22] Filed: Jun. 3, 1982

Related U.S. Application Data

[63] Continuation of Ser. No. 112,475, Jan. 16, 1980, abandoned.

[30] Foreign Application Priority Data

Jun. 16, 1979 [NO] Norway ..... 790148

[51] Int. Cl.[3] ..... F42B 11/24

[52] U.S. Cl. ..... 102/364; 102/503; 102/517

[58] Field of Search ..... 102/364, 473, 501, 503, 102/517–519

[56] References Cited

U.S. PATENT DOCUMENTS

| | | | |
|---|---|---|---|
| 1,283,158 | 10/1918 | Griffith | 102/503 |
| 1,320,495 | 11/1919 | Rohling | 102/503 |
| 1,327,531 | 6/1920 | Durham | 102/503 |
| 3,013,495 | 12/1961 | Stevenson et al. | 102/364 |
| 3,302,570 | 2/1967 | Marquardt | 102/364 |
| 3,677,181 | 7/1972 | Giljarhus et al. | 102/364 |
| 3,726,495 | 4/1973 | Gawlick et al. | 102/503 |
| 3,941,057 | 3/1976 | Peterson et al. | 102/364 |
| 4,237,787 | 12/1980 | Wacula et al. | 102/364 |

FOREIGN PATENT DOCUMENTS

| | | | |
|---|---|---|---|
| 1192170 | 10/1959 | France | 102/514 |

*Primary Examiner*—Harold J. Tudor

*Attorney, Agent, or Firm*—Larson and Taylor

[57] ABSTRACT

A tubular projectile having a rear end with a sabot and an open front end is characterized in that it comprises an interior and an exterior cylindrical wall, concentrically arranged, between which at least one incendiary charge is provided in front of at least one explosive charge, as seen in the moving direction of said projectile, and that said forward combustion charges are covered by a cover in front.

5 Claims, 3 Drawing Figures

TUBULAR PROJECTILE

Figure 1:
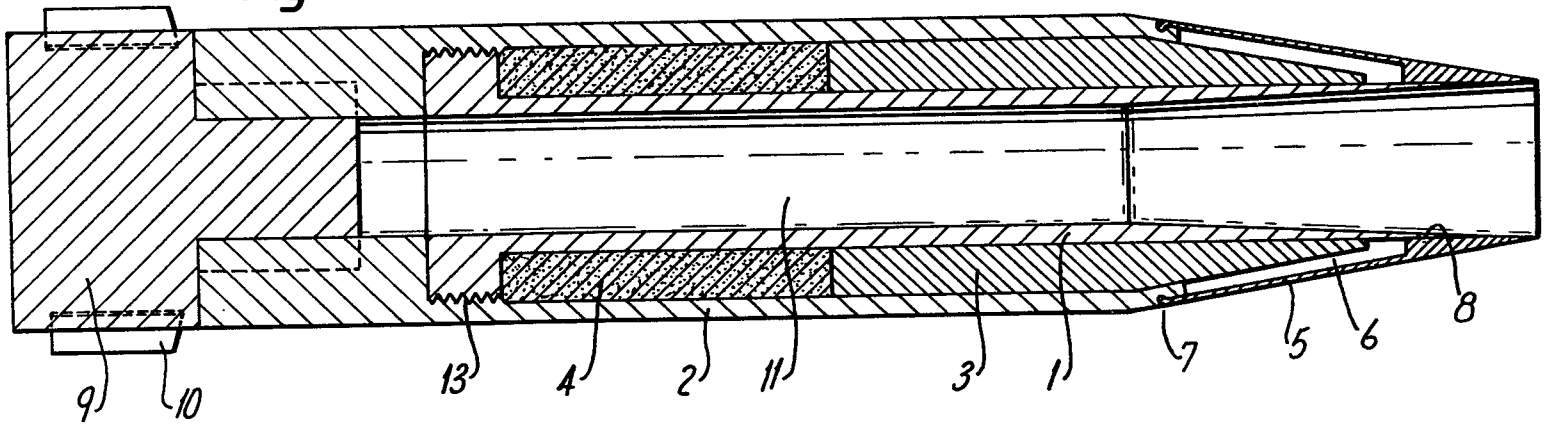

This is a continuation of the application Ser. No. 112,475 filed Jan. 16, 1980, now abandoned.

The present invention relates to a tubular projectile having a rear end with a sabot and an open forward end.

A very important quality of projectiles is supersonic speed, by which two essential advantages are achieved;

(a) Short flight time increasing the probability of hitting, and (b) high impact velocity which in turn results in a good piercing effect.

The conventional projectile shape is a substantially sylindrical body, which tapers to a sharp or blunt point in front.

To improve the aerodynamic qualities of said projectiles it has been suggested to provide them with an open interior channel or construct tubular projectiles.

For discharging said projectiles having their interior void, preferably the rear part of said void, must be provided with a sabot that is blown off after discharge.

Such projectiles are described in the German Patent Specification No. 1 703 747, German Patent Nos. 70 644, and 217 649 the German DOS Nos. 2 229 443, and 2 753 633. In the German DOS Nos. 2 454 584, and 2 753 633 the special aerodynamic conditions when tubular projectiles are fired have also been described.

All above mentioned publications concern cold projectiles, i.e. projectiles that have no incendiary and explosive effect.

Incendiary and/or explosive effects are often desired in projectiles. When such effects are desired of the projectile, the following problems have previously been encountered in connection with tubular projectiles:

(a) Difficulties in arranging charges in the projectile.

(b) Difficulties in mounting igniton means.

(c) To maintain the piercing effect of the projectile it must detonate after or during penetration.

The applicant does not know of any existing tubular projectiles having the following combination of characteristics:

(a) Blast effect (b) Splintering effect (c) Incendiary effect (d) Function in targets with delayed detonation It is, thus, object of the present invention to provide a tubular projectile having the above mentioned characteristics. According to the invention a tubular projectile having a rear end with a sabot and an open forward end is characterized in that it is provided with an interior and an exterior cylindrical wall, concentrically arranged between which at least one combustive charge is provided in front of at least one explosive charge, as seen in the direction of movement of the projectile, and that the incendiary charge in front is covered by a cover.

In a preferred embodiment the tubular projectile is loaded with a incendiary charge succeeded by an explosive charge.

Between said incendiary charge and said cover an air gap is preferably arranged. When the projectile is discharged, the developing forces affecting said incendiary charge will be greater than the binding forces keeping the charge solidly together, and due to rotation of the projectile said charge will be brought into contact with said cover.

Said cover is preferably shaped so as to engage a flange facing inwards with a recess in the cylindrical exterior wall of the tubular projectile.

Inside its tapered front end said cover can be secured to the outside of the interior cylindrical wall, e.g. by glueing.

Furthermore, an interior collar of said cover can engage a correspondingly shaped shoulder on the outside of the front portion of the interior cylindrical wall.

By the described tubular projectile the problem of achieving the above mentioned combined effects has been solved in a surprising manner and the mentioned great advantages of the high flight speed of tubular projectiles have been achieved as well.

Another decisive advantage of this construciton is that complicated ignition mechanisms are avoided. Such mechanisms would be constructively very demanding in a tubular projectile. By a relatively simple construction a projectile is achieved that can be handled with unusually high safety, there being no mechanical ignition means which contain primary explosives. The present solution of the technical problems involved, thus, constitutes a non-obvious solution of a technical problem.

The present invention will now be described in more detail with reference to the accompanying drawings, the inventive idea, however, not being strictly limited to the disclosed embodiments.

FIG. 1 shows a longitudinal section through a tubular projectile according to the invention. Said projectile is composed of an interior cylindrical portion 1 and an exterior cylindrical portion 2, which are screwed together by complementary threading on each cylindrical portion and, thus, form a coaxial double cylinder along most of the projectile length. The explosive charge 4 is first forced into the void formed between said two cylindrical walls by the aid of an annular piston. Then a combustive charge 3 is arranged in the projectile in front of said explosive charge 4, as seen in the moving direction of said projectile. The combustive charge 3 is pressed in as is the explosive charge 4. Such pressing operation has to be carried out by a loading/pressing device which shapes the front portion of said combustive charge with an inclined outward face as shown in FIG. 1. The front end of the projectile is covered by a cover 5 leaving air gap 6. The material of said cover can be aluminium or thin steel plate. An inward flange 7 on said cover engages a complementary recess in the exterior of the external cylindrical projectile wall, so as to secure said cover in place. The contact area 8 of said cover with said interior steel cylinder 1 is press fit and provided with a glued joint for reinforcement. The rear end of said projectile is provided with a sabot 9 for discharge. Said sabot, is furthermore, provided with a steering strip 10 for establishing rotation and for sealing against the discharge barrel. Upon discharge said sabot 9 is released and separated from the projectile due to the shock waves developing in said tubular projectile. Sabots of this kind are previously known and a special embodiment of them is not critical.

Figure 2:
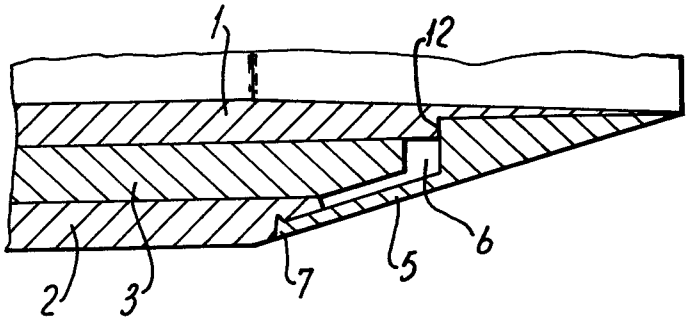

FIG. 2 shows a section of one side of the tubular projectile comprising another embodiment of cover 5. In this embodiment said cover rests with an inside collar on a correspondingly shaped shoulder 12 on the outside of the interior cylinder wall leaving air gap 6. The front end of the interior cylinder wall may here taper together with the front cover end. The remaining details are in principle analogous to FIG. 1.

Figure 3:
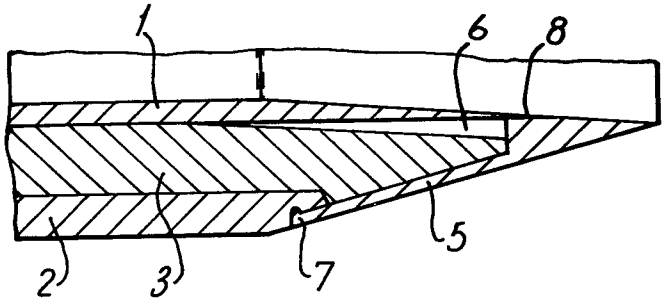

In FIG. 3 half of a front portion like that of FIG. 1 is shown in section after discharge of the projectile, the incendiary charge 3 in the forward projectile portion having its inclined outward face deformed relative to its shape before discharge according to FIG. 1. Due to the influence of rotational and retarding forces the binding forces between the incendiary charge particles have broken down and the particles are forced outward and forward. The original air gap 6 is now located inside the front portion of the incendiary charge towards the interior cylinder wall.

The air gap 6 will improve the ignition transfer properties of the incendiary charge to the high explosive charge.

The arrangement of the incendiary charge as disclosed in FIG. 1 causes ignition of the incendiary by rapid deformation of the cover. Said rapid deformation is achieved when the projectile hits a target.

Since tubular projectiles hit targets with a higher velocity than conventionally shaped projectiles, ignition can be achieved upon impact even on relatively thin plates.

When the projectile hits a target in an inclined position the heavy impact on the target plate will act upon the cover side, which results in still more advantageous conditions as regards friction and ignition.

The inventive idea is defined in the following claims.

I claim:

1. A tubular projectile having a rear end with a sabot and an open front end, characterized in that is comprises an interior and an exterior cylindrical wall, concentrically arranged, between which at least one incendiary charge is provided in front of at least one explsoive charge, as seen in the moving direction of said projectile, the incendiary charge being constructed to ignite on impact and then to ignite the explosive charge after a predetermined delay, and including a cover in front of said incendiary charge, said cover being a separate piece from the interior and exterior walls, and having a portion which is thinner and more deformable than the interior and exterior walls, said cover being firmly secured to the forward end of the interior and exterior walls.

2. A tubular projectile according to claim 1, including an air gap between said incendiary charge and said cover.

3. A tubular projectile according to claim 1, wherein said cover engages a recess in the exterior cylindrical wall with an inward flange.

4. A tubular projectile according to claim 1, wherein the cover is secured with the inside of its pointed front end to the outside of the interior cylindrical wall.

5. A tubular projectile according to claim 1, wherein said cover has an interior collar which engages a correspondingly shaped shoulder on the outside of the front portion of the interior cylindrical wall.

* * * * *